US005098554A

United States Patent [19]

Krishna et al.

[11] Patent Number: 5,098,554

[45] Date of Patent: Mar. 24, 1992

[54] EXPEDIENT METHOD FOR ALTERING THE YIELD DISTRIBUTION FROM FLUID CATALYTIC CRACKING UNITS

[75] Inventors: Ashok S. Krishna, Concord; Alan R. English, Point Richmond, both of Calif.; Michael F. Raterman, Doylestown, Pa.

[73] Assignee: Chevron Research Company, San Francisco, Calif.

[21] Appl. No.: 590,434

[22] Filed: Sep. 26, 1990

Related U.S. Application Data

[63] Continuation of Ser. No. 489,847, Mar. 2, 1990, abandoned, which is a continuation of Ser. No. 258,249, Oct. 14, 1988, abandoned, which is a continuation of Ser. No. 134,765, Dec. 18, 1987, abandoned, which is a continuation of Ser. No. 792,722, Oct. 30, 1985, abandoned.

[51] Int. Cl.[5] ..... C10G 11/00

[52] U.S. Cl. ..... 208/113; 208/120; 208/127; 208/158; 208/162; 208/253

[58] Field of Search ..... 208/113, 120, 158, 162, 208/127, 253

[56] References Cited

U.S. PATENT DOCUMENTS

| | | | |
|---|---|---|---|
| 2,994,659 | 8/1961 | Slyngstad et al. | 208/113 |
| 3,042,196 | 7/1962 | Payton et al. | 208/113 |
| 3,193,494 | 7/1965 | Sanford et al. | 208/113 |
| 3,959,117 | 5/1976 | Bunn | 208/113 |
| 4,345,991 | 8/1982 | Stegelman | 208/113 |
| 4,405,445 | 9/1983 | Kovach | 208/113 |

FOREIGN PATENT DOCUMENTS

| | | | |
|---|---|---|---|
| 0101878 | 3/1984 | European Pat. Off. | 208/113 |

*Primary Examiner*—Asok Pal

*Attorney, Agent, or Firm*—A. H. Uzzell; W. K. Turner

[57] ABSTRACT

A fluid catalytic cracking unit equipped with multiple feed injection points along the length of the riser is operated such that all of the fresh feed is charged to one of different feed injection points, depending on the ratio of light distillate (gasoline) to middle distillate (light catalytic gas oil) that is desired in the product slate. When all of the fresh feed is charged to one of the upper injection points in the riser in order to increase middle distillate yield, the unconverted slurry oil (650° F.+material) can be recycled to a location below the injection point of the fresh feed so as to increase conversion to middle distillate while lowering the activity of the catalyst (via coke deposition) for single pass conversion of the fresh feed. Steam in excess of levels typically employed for dispersion is used at the bottom of the riser to lift the regenerated catalyst up to the feed injection points. Other inert gases can be used in place of, or in conjunction with steam to accomplish lifting of catalyst in the riser.

10 Claims, 2 Drawing Sheets

EXPEDIENT METHOD FOR ALTERING THE YIELD DISTRIBUTION FROM FLUID CATALYTIC CRACKING UNITS

This application is a continuation of application Ser. No. 489,847 filed Mar. 2, 1990 now abandoned, which in turn is a continuation of application Ser. No. 258,249 filed Oct. 14, 1988, now abandoned, which in turn is a continuation of application Ser. No. 134,765 filed Dec. 18, 1987, now abandoned, which in turn is a continuation of application Ser. No. 792,722 filed Oct. 30, 1985, now abandoned.

FIELD OF INVENTION

The invention relates generally to catalytic cracking of hydrocarbons. In one aspect the invention relates to a change in the method of introduction of the feed, thereby creating an advantageous increase in yield and quality of light catalytic gas oil while minimizing loss in the octane number of the gasoline. Particularly, the invention relates to selective but reversible alteration in the yield distribution from catalytic cracking toward more middle distillate (light catalytic gas oil) and less light distillate (gasoline).

BACKGROUND OF INVENTION

Feedstocks containing higher molecular weight hydrocarbons are cracked by contacting the feedstocks under elevated temperatures with a cracking catalyst whereby light and middle distillates are produced. Typically, the yield ratio of light distillate (gasoline) to middle distillate is dependent upon the conversion level, therefore to increase the make of middle distillate, a corresponding decrease in conversion must be experienced. Unfortunately, this decrease in conversion requires significant changes in operating conditions which can have a detrimental impact on gasoline octane quality, or a change in catalyst type which can be time consuming and costly. Furthermore, presently available techniques for lowering the conversion level in a cracking operation, such as lowering reactor temperature, result in poor selectivity to the desired middle distillate product, and instead, lead to high yields of undesirable heavy, 650° F.+ slurry oils. Therefore, with the current increase in demand for middle distillate fuels, it is desirable to have a modified cracking process available for quickly and reversibly changing from a maximum gasoline mode of operation to a maximum middle distillate mode of operation while minimizing loss in the octane number of the gasoline, to meet both seasonal and longer term fluctuations in the relative demand for distillate products Present and forecasted future trends in the petroleum industry indicate significant changes in the demand patterns for petroleum products. The demand for gasoline has declined considerably, and is expected to decline further in the future. On the other hand, the demand for middle distillate products is on the rise. The fluid catalytic cracking process was invented to meet growing demand for gasoline in the 1930's and 1940's, and has traditionally been a process for maximizing the yield of gasoline from petroleum derived charge stocks. With the changes in demand trends described above, the present invention contemplates a new mode of operation of the fluid catalytic cracking process to advantageously shift yields to meet product demand changes.

It is thus one object of this invention to provide a regenerated cracking process, and a further object of this invention to provide a process for reversibly modifying the yield distribution of products from the process. Another object of this invention is to shift the yield distribution associated with a cracking process toward middle distillate.

Yet another object of this invention is to provide a process for switching from a maximum gasoline mode to a maximum distillate mode of operation, and back again to a maximum gasoline mode in a quick and reversible manner.

SUMMARY OF INVENTION

In accordance with this invention, we have found that a desirable way to advantageously shift the yield distribution toward more middle distillate is to charge all of the fresh feed to an upper injection point along the length of the riser while utilizing excess steam or other gaseous diluents in conjunction with slurry recycle to lift the regenerated catalyst from the bottom of the riser.

It is well known, of course, that the operating severity in a fluid catalytic cracking process can be lowered by lowering the temperature of operation or lowering catalyst to oil ratio (by raising feed preheat temperatures) for example, to increase the yield of middle distillate. The process, however, heretofore, has been generally unrewarding because the gasoline produced from the process is lower in octane number, and the selectivity to middle distillate vis-a-vis heavy slurry oil is poor. Similarly, it is also well known that cracking catalysts can be manufactured with a wide range of activities, and that lower activity catalysts can be employed in the cracking process to reduce conversion and increase the yield of middle distillate. However, such a process also suffers from poor selectivity to the desired product and from loss in product quality. In addition, changing catalyst in a commercial fluid catalytic cracking unit may take several weeks to accomplish and thus a poor method for responding to quick, seasonal changes in product demand shifts.

Our invention, therefore, contemplates the use of multiple feed injection points along the riser to effect a switch quickly from maximum gasoline mode to maximum middle distillate mode of operation in cracking units. It is an object of this invention to charge all of the regenerated catalyst and all of the fresh feed to the lowest injection point in the riser for maximizing the yield of gasoline. When middle distillate maximization is desired, all of the fresh feed is, in accordance with the present invention, charged to an upper injection point. Additional steam, in excess of that required for the maximum gasoline mode of operation, in used to lift the regenerated catalyst to the upper feed injection point. First pass conversion of the fresh feed charged to the upper injection point is thus minimized without lowering temperature of operation, by reducing oil residence time in the riser reactor. The unconverted slurry oil is recycled to the bottom injector in order to maximize the ratio of middle to light distillates in the effluent products.

DETAILED DESCRIPTION OF THE INVENTION

Figure 1:
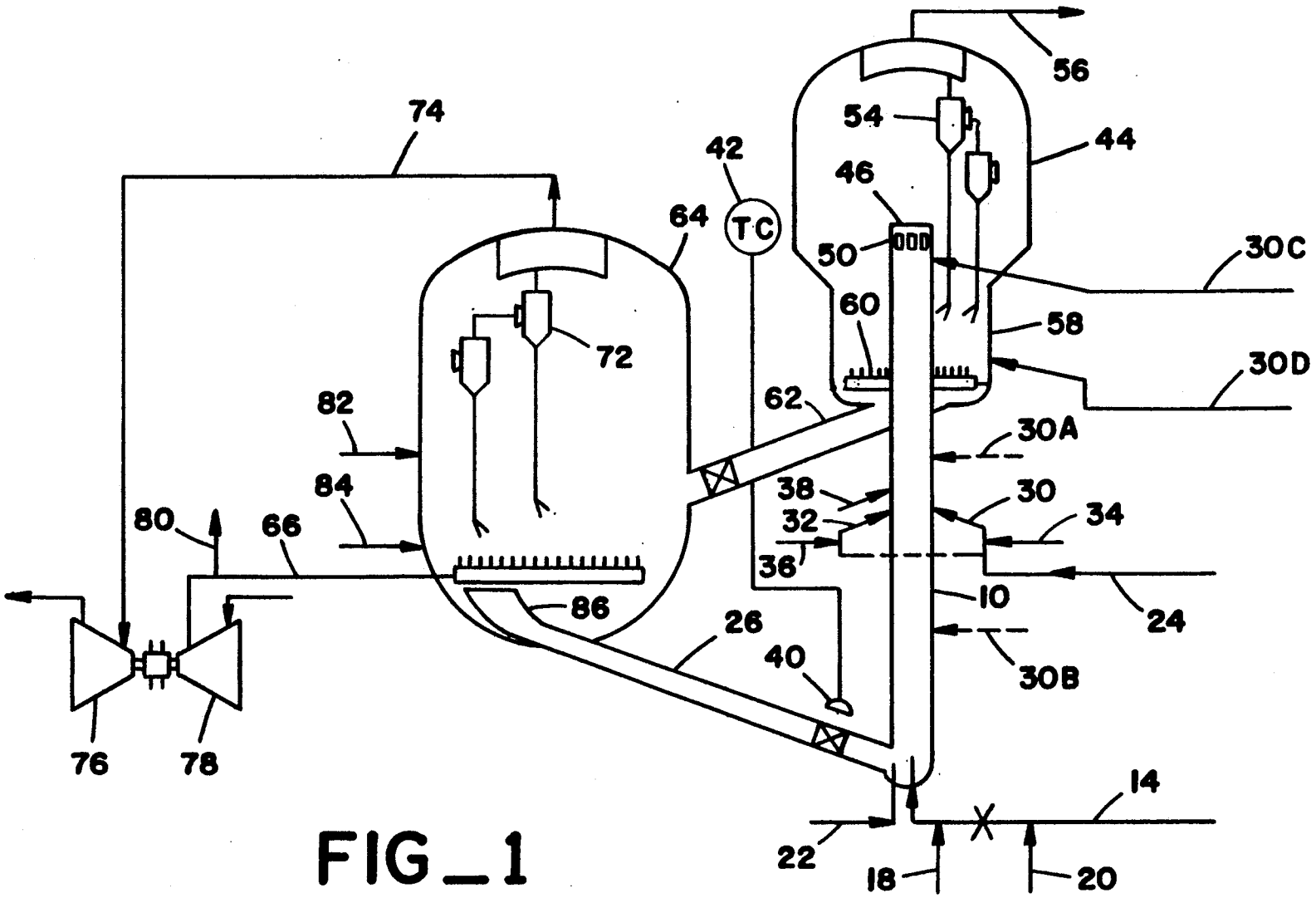
FIG. 1 represents the reactor-regenerator system for performing the invention process.

A suitable reactor-regenerator system for performing this invention is described in reference to FIG. 1. The cracking occurs with a fluidized zeolitic catalyst in an elongated reactor tube 10, which is referred to as a riser. The riser has a length to diameter ratio of above 20, or preferably above 25. Hydrocarbon oil feed in line 20 to be cracked can be charged directly into the bottom of the riser through inlet line 14 or it can be charged to upper injection points in the riser through lines 30A, 30B, or 30C or directly into the reactor vessel through line 30D. Steam is introduced into the lower feed injection point through line 18. Steam is also introduced independently to the bottom of the riser through line 22 to help carry upwardly into the riser regenerated catalyst which flows to the bottom of the riser through transfer line 26.

Feed to the upper injection points is introduced at about a 45 degree upward angle into the riser through lines 24, 30 and 32. Steam can be introduced into the upper feed injection inlet lines through lines 34 and 36. Upper hydrocarbon feed injection lines 30 and 32 each represent a plurality of similar lines spaced circumferentially at the same height of the riser. Any recycle hydrocarbon can be admitted to the lower section of the riser through one of the inlet lines designated as 20, or to the upper section of the riser through one of the lines designated as 38. The residence time of hydrocarbon feed in the riser can be varied by varying the amounts or positions of introduction of the feed.

The full range oil charge to be cracked in the riser is a gas oil having a boiling range of about 430° F. to 1100° F. The feedstock to be cracked can also include appreciable amounts of virgin or hydrotreated residua having a boiling range of 900° F. to 1500° F. The steam added to the riser amounts to about 2 wt % based on the oil charge, but the amount of steam can vary widely. A larger amount of steam, in the range of 10–15 wt % of oil charge, is required to lift the catalyst when all of the hydrocarbon feed is being charged to upper injection points along the riser. The catalyst employed may be fluidized zeolitic aluminosilicate and is preferably added to the bottom only of the riser. The riser temperature range is preferably about 900° F. to 1100° F. and is controlled by measuring the temperature of the product from the risers and then adjusting the opening of valve 40 by means of temperature controller 42 which regulates the inflow of hot regenerated catalyst to the bottom of the riser. The temperature of the regenerator catalyst should be above the control temperature in the riser so that the incoming catalyst contributes heat to the cracking reaction. The riser pressure should be between about 10 and 35 psig. Between about 0 and 5% of the oil charge to the riser is recycled with the fresh oil feed to the bottom of the riser for the maximum gasoline mode of operation. When middle distillate maximization is desired, all of the fresh oil feed is charged to upper injection points to lower first pass conversion. Under this mode of operation, significantly higher rates of slurry oil recycle in the range of 5 to 50% of the oil charge is contemplated, and the majority of the recycle material is returned to an injection point below that of the fresh oil injection point.

The residence time of both hydrocarbon and catalyst in the riser is very small and preferably ranges from 0.5 to 5 seconds. For the maximum gasoline mode of operation, the hydrocarbon is usually in the riser for about two seconds because it is introduced to the bottom of the riser but for the maximum distillate mode of operation, the fresh oil feed will generally be in the riser for no more than about one second because it is introduced into the top of the riser. The velocity throughout the riser is about 35 to 65 feet per second and is sufficiently high so that there is little or no slippage between the hydrocarbon and catalyst flowing through the riser. Therefore, no bed of catalyst is permitted to build up within the riser, whereby the density within the riser is very low. The density within the riser ranges from a maximum of about 4 pounds per cubic foot at the bottom of the riser and decreases to about 2 pounds per cubic foot at the top of the riser. Since no dense bed of catalyst is ordinarily permitted to build up within the riser, the space velocity through the riser is usually high and ranges between 100 or 120 and 600 weight of hydrocarbon per hour per instantaneous weight of catalyst in the reactor. No significant catalyst buildup within the reactor should be permitted to occur and the instantaneous catalyst inventory within the riser is due to a flowing catalyst to oil weight ratio between about 4:1 and 15:1, the weight ratio corresponding to the feed ratio.

The hydrocarbon and catalyst exiting from the top of each riser is passed into a disengaging vessel 44. The top of the riser is capped at 46 so that discharge occurs through lateral slots 50 for proper dispersion. An instantaneous separation between hydrocarbon and catalyst occurs in the disengaging vessel. The hydrocarbon which separates from the catalyst is primarily gasoline together with middle distillate and heavier components and some lighter gaseous components. The hydrocarbon effluent passes through cyclone system 54 to separate catalyst fines contained therein and is discharged to a fractionator through line 56. The catalyst separated from hydrocarbon in disengager 44 immediately drops below the outlets of the riser so that there is no catalyst level in the disengager but only in a lower stripper section 58. Steam is introduced into catalyst stripper section 58 through sparger 60 to remove any entrained hydrocarbon in the catalyst.

Catalyst leaving stripper 58 passes through transfer line 62 to a regenerator 64. This catalyst contains carbon deposits which tend to lower its cracking activity and as much carbon as possible must be burned from the surface of the catalyst. The burning is accomplished by introduction to the regenerator through line 66 of approximately the stoichiometrically required amount of air for combustion of the carbon deposits. The catalyst from the stripper enters the bottom section of the regenerator in a radial and downward direction through transfer line 62. Flue gas leaving the dense catalyst bed in regenerator 64 flows through cyclones 72 wherein catalyst fines are separated from flue gas permitting the flue gas to leave the regenerator through line 74 and pass through a turbine 76 before leaving for a waste heat boiler, wherein any carbon monoxide contained in the flue gas is burned to carbon dioxide to accomplish heat recovery. Turbine 76 compresses atmospheric air in air compressor 78 and this air is charged to the bottom of the regenerator through line 66.

The temperature throughout the dense catalyst bed in the regenerator is about 1250° F. The temperature of the flue gas leaving the top of the catalyst bed in the regenerator can rise due to afterburning of carbon monoxide to carbon dioxide. Approximately a stoichiometric amount of oxygen is charged to the regenerator in order to minimize afterburning of carbon monoxide to carbon dioxide above the catalyst bed, thereby avoiding injury to the equipment, since at the temperature of the regenerator flue gas some afterburning does occur. In order to prevent excessively high temperatures in the regenerator flue gas due to afterburning, the temperature of the regenerator flue gas is controlled by measuring the temperature of the flue gas entering the cyclones and then venting some of the pressurized air otherwise destined to be charged to the bottom of the regenerator through vent line 80 in response to this measurement. Alternatively, CO oxidation promoters can be employed, as is now well known in the art, to oxidize the CO completely to $CO_2$ in the regenerator dense bed thereby eliminating any problems due to afterburning in the dilute phase. With complete CO combustion, regenerator temperatures can be in excess of 1250° F. up to 1500° F. The regenerator reduces the carbon content of the catalyst from about 1.0 wt % to 0.2 wt %, or less for the maximum gasoline mode of operation. When distillate maximization is desired, the carbon level on regenerated catalyst can be higher than 0.2 wt % up to about 0.5 wt %. If required, steam is available through line 82 for cooling the regenerator. Makeup catalyst may be added to the bottom of the regenerator through line 84. Hopper 86 is disposed at the bottom of the regenerator for receiving regenerated catalyst to be passed to the bottom of the reactor riser through transfer line 26.

Figure 2:
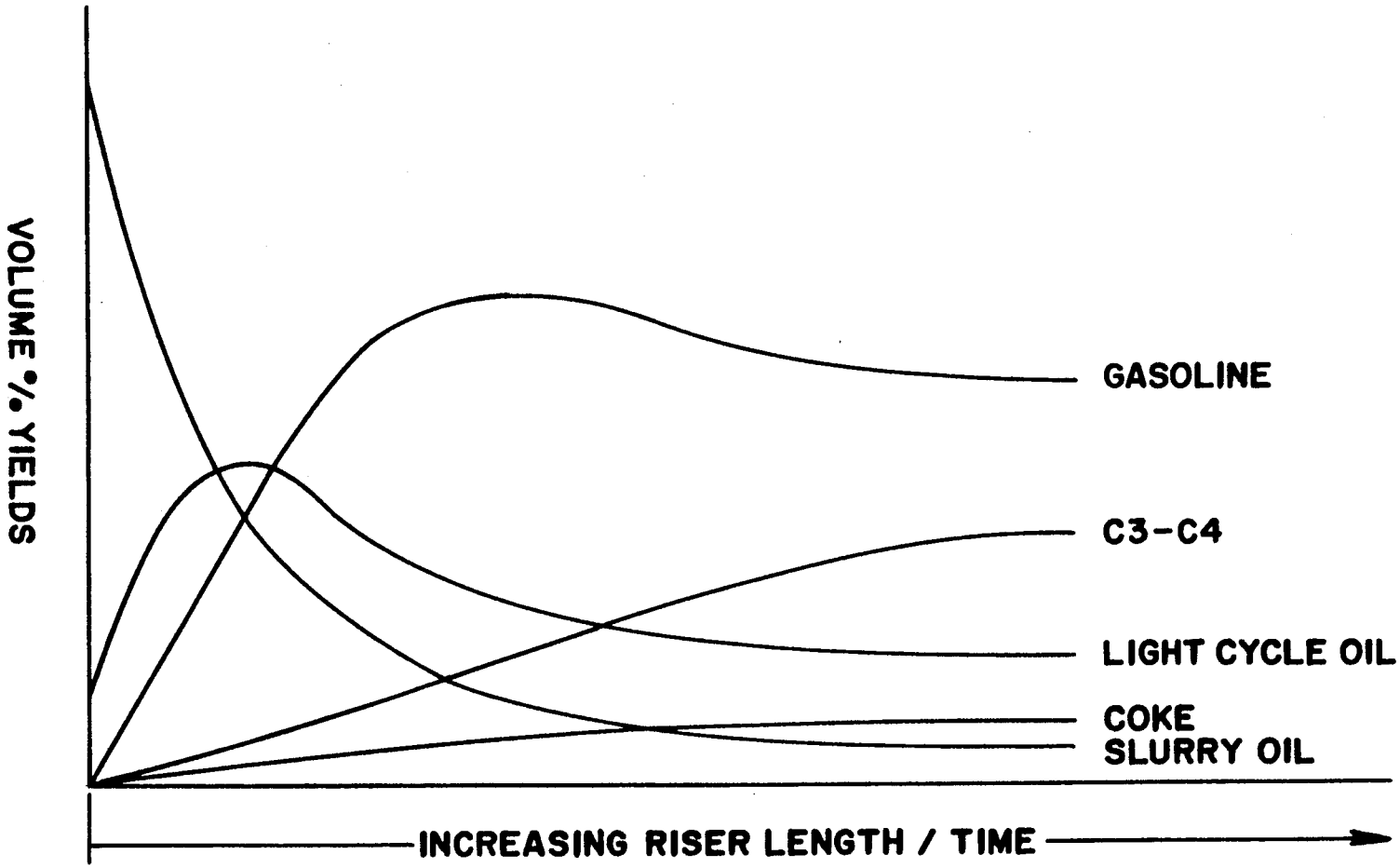
FIG. 2 shows the effect of the riser residence time on product yield distribution.

The process of this invention can be illustrated by examining the effect of riser residence time on product yield distributions as shown in FIG. 2. Maximum yield of middle distillate (light catalytic gas oil) is achieved at a residence time that is lower than that which maximizes the yield of light distillate (gasoline). Thus, it is one object of this invention to lower the oil residence time in the riser when switching from maximum gasoline to maximum distillate modes of operation by charging all of the fresh oil feed to upper injection points along the riser. The exact position of feed injection will depend upon the extent to which a shift in the ratio of light to middle distillate yield is desired. Further reductions in residence time are achieved by virtue of the increased amount of steam that is required to lift the regenerated catalyst from the bottom of the riser to the upper feed injection point. In addition, it has been found that the steam in contact with the hot, regenerated catalyst prior to contact with oil can passivate the detrimental dehydrogenation functions of deposited metals such as nickel and vanadium plus improve performance. It is also contemplated that gases such as hydrogen, hydrogen sulfide, ammonia, recycled absorber or wet gas, and $C_1$–$C_3$ hydrocarbons can be used in conjunction with or in place of steam to help lift the regenerated catalyst up the riser.

From FIG. 2 it is apparent that when the oil residence time is reduced, an undesired increase in the yield of heavy slurry oil also occurs. In addition, the yield of coke is reduced, requiring other undesired changes in unit operation to achieve heat balance. It has been discovered that in conjunction with the residence time reduction via oil charge to an upper injection point, recycling of the unconverted slurry oil to the bottom of the riser serves to further shift and yield distribution toward middle distillate in two different ways. First, the refractory, unconverted slurry oil that contacts the hot, regenerated catalyst at the bottom of the riser is cracked at very high temperatures and catalyst/oil ratios because of the absence of fresh oil feed. At such high severity, the refractory recycle oil is converted to a greater extent than that achieved by the prior art, and conversion to middle can be maximized by a judicious choice of recycle rate and position of introduction into the riser. Secondly, the cracking of slurry oil produces coke which deposits on the catalyst and raises the carbon level (and therefore lowers the activity) of the catalyst prior to contact with oil. This reduction in catalyst activity caused by coke deposition due to severe cracking of the recycle material serves to minimize first pass conversion of the oil feed. In accordance with this invention, the introduction of the slurry oil recycle material to the bottom of the riser also serves to produce the coke required to compensate for the reduction in coke make due to the low single passed conversion of the fresh feed in the upper portion of the riser, and thereby enable the process to achieve heat balance. Furthermore, the material recycled to the bottom of the riser also serves to assist in lifting the regenerated catalyst, along with excess steam, to the upper injection point in the riser.

An important aspect of this invention is the high quality of the light distillate (gasoline) that is produced while the yield of middle distillate (light catalytic gas oil) is maximized. Currently available techniques for maximizing middle distillate yield in fluid catalytic cracking units involve reductions in single pass conversion by lowering reactor temperature. The desired shift in yield distribution is achieved, but only at the expense of gasoline octanes. We overcome these disadvantages of the prior art by providing a process wherein the loss in gasoline octanes is minimized while the yield of middle distillate is maximized. This favorable result is achieved by a combination of two factors. First, the reduction in single pass conversion is achieved by lowering oil residence time in the riser at constant temperature of operation. The reduction in residence time serves to minimize hydrogen transfer reactions thereby preserving more olefins in the gasoline fraction. This increase in olefinic content of the gasoline compensates for lower aromatics content caused by the reduction in conversion, and loss in octane number is minimized. Secondly, the unconverted slurry oil resulting from the low single pass conversion in the upper region of the riser is recycled to the bottom of the riser where it is cracked at very severity (high temperature and catalyst/oil ratio), thereby producing gasoline with high octane numbers.

EXAMPLES

To demonstrate the efficacy of our invention, a number of tests were conducted using a microactivity unit and a circulating FCC pilot plant using catalysts and feedstocks described in Tables I and II, respectively, and computer simulations were performed using a mathematical model of the fluid catalyst cracking process. The equilibrium samples of catalysts used were obtained from various commercial fluid catalytic cracking units.

Example I

Table III presents pilot plant data on cracking of a gas oil feed using a conventional high activity zeolitic catalyst in the pilot plant, first by charging all the feed to the bottom of the riser to maximize gasoline yield and next, to an upper injection point to lower conversion and shift the yield distribution toward middle distillate. The date in columns 1 and 2 of Table III show that significant increases in the middle distillate/gasoline yield ratio can be achieved by operating the pilot plant in accordance with the present invention. A review of the gasoline quality data also indicates that the hydrocarbon distribution in gasoline is markedly different for the two runs. While the aromatic content of the gasoline is lower for Run No. 2 (feed charged to the upper injector), the olefinic content is significantly higher, resulting in very small decreases in the research and motor octane numbers of the gasoline.

TABLE I

EQUILIBRIUM CATALYST INSPECTIONS

| Catalyst Description | Catalyst 1 | Catalyst 2 | Catalyst 3 |
|---|---|---|---|
| Activity (Microactivity Test) | 72.7 | 69.3 | 72.5 |
| Physical Characteristics | | | |
| Surface Area: $m^2/g$ | 145.4 | 105.2 | 115.3 |
| Pore Volume: cc/g | 0.154 | 0.231 | 0.145 |
| Apparent Bulk Density: g/cc | 0.844 | 0.811 | 0.766 |
| Compacted Bulk Density: g/cc | 0.955 | 0.893 | 0.874 |
| Chemical Composition, Wt % | | | |
| Carbon | 0.12 | 0.14 | 0.21 |
| Iron ($Fe_2O_3$) | 0.83 | 0.96 | 1.07 |
| Nickel (Ni) | 0.024 | 0.063 | 0.18 |
| Vanadium (V) | 0.027 | 0.091 | 0.15 |
| Sodium (Na) | 0.41 | 0.71 | 0.40 |
| Alumina ($Al_2O_3$) | 45.0 | 46.9 | 42.7 |
| Titanium (Ti) | 0.41 | 0.96 | 0.97 |
| Cerium (Ce) | 0.74 | 0.53 | — |
| Lanthanum (La) | 1.01 | 1.35 | — |
| Neodymium (Nd) | 0.43 | 0.44 | — |
| Praseodymium (Pr) | 0.24 | 0.31 | — |

TABLE II

FEEDSTOCK INSPECTIONS

| Description | Feed 1 | Feed 2 | Feed 3 |
|---|---|---|---|
| API Gravity | 27.9 | 21.7 | 22.8 |
| Sulfur: Wt % | 0.59 | 1.56 | 1.89 |
| Nitrogen: Wt % | 0.09 | 0.17 | 0.085 |
| Hydrogen: Wt % | 12.72 | 12.00 | 11.98 |
| Carbon Residue: Wt % | 0.38 | 4.6 | 0.39 |
| Aniline Point: °F. | 190.2 | 174.2 | 172.4 |
| Viscosity @ 210° F. | 40.9 | 51.7 | 45.2 |
| Pour Point: °F. | +100 | +64.4 | +95 |
| Nickel: ppm | 0.3 | 10 | 0.3 |
| Vanadium: ppm | 0.3 | 33 | 0.5 |
| Distillation: D1160 | | | |
| 10% | 595 | 510 | 666 |
| 30% | 685 | 628 | 740 |
| 50% | 765 | 780 | 791 |
| 70% | 845 | — | 856 |
| 90% | 934 | — | 943 |
| EP | 1020 | | |
| Hydrocarbon Types: Mass Spec. | | | |
| Aromatics | 32.2 | 37.2 | 49.3 |
| Mono | 11.8 | 18.9 | 21.6 |
| Di | 10.9 | 12.5 | 14.8 |
| Tri+ | 9.5 | 5.8 | 7.0 |
| Saturates | 61.7 | 45.9 | 49.5 |
| Alkanes | 25.2 | 19.8 | 18.5 |
| Cycloalkanes | 36.5 | 26.1 | 31.0 |
| Polar Compounds | 0.8 | 7.4 | 1.2 |
| Insolubles | 5.3 | 2.5 | — |
| Volatiles | — | 7.0 | — |

TABLE III

| Run Number | 1 | 2 |
|---|---|---|
| Chargestock | ← Feed 1 → | |
| Catalyst | ← Catalyst 1 → | |
| Operating Conditions | | |

TABLE III-continued

| Run Number | 1 | 2 |
|---|---|---|
| Riser Outlet Temp., °F. | ← 980 → | |
| Riser Inlet Temp., °F. | ← 1200 → | |
| Riser Feed Injector | Bottom | Top |
| Contact Time (Products), sec. | 2.16 | 0.62 |
| Conversion: Vol % FF | 76.3 | 69.0 |
| Product Yields: Vol % FF | | |
| Total $C_3$ | 12.3 | 9.6 |
| $C_3$= | 10.5 | 8.0 |
| Total $C_4$ | 18.6 | 14.2 |
| $iC_4$ | 5.6 | 3.6 |
| $C_4$= | 11.4 | 9.4 |
| $C_5$–430° F. Gasoline | 57.5 | 56.3 |
| 430–650° F. Light Catalytic Gas Oil | 14.4 | 18.6 |
| 650° F.+ Decanted Oil | 9.3 | 12.4 |
| $C_3$+ Liquid | 112.1 | 111.1 |
| Product Yields: Wt % FF | | |
| $C_2$ and Lighter | 2.1 | 1.5 |
| Coke | 4.7 | 3.8 |
| Gasoline | | |
| API | 56.7 | 57.5 |
| Aromatics: Vol % | 29.2 | 22.1 |
| Olefins: Vol % | 39.2 | 51.0 |
| Saturates: Vol % | 31.6 | 26.8 |
| Motor Octane Clear | 79.0 | 78.7 |
| Research Octane Clear | 92.0 | 91.6 |
| Light Catalytic Gas Oil | | |
| API | 22.4 | 26.3 |
| Aromatics: Vol % | 57.8 | 46.3 |
| Olefins: Vol % | — | — |
| Saturates: Vol % | 42.2 | 53.7 |
| Pour: °F. | −9 | −12 |
| Decanted Oil | | |
| API | 11.1 | 16.9 |

Example II

In this example, the pilot plant tests were conducted with a heavy feed containing 20% by volume of vacuum tower bottoms admixed with gas oil. Columns 1 and 2 of Table IV compare pilot plant operation with lower and upper feed injectors, respectively, and show the desired shift in gasoline to distillate ratio in accordance with the present invention.

Example III

Table V shows pilot plant data comparing one run with gas oil feed injection to the bottom of the riser with a second run, wherein the gas oil feed was charged to an upper injection point in the riser accompanied by recycle of unconverted slurry oil to the bottom injector. The results demonstrate the desired shifts in yields of products and the improved performance achieved by practicing one aspect of the present invention.

Example IV

In another embodiment of this invention, it is contemplated that high amounts of steam will be used to lift the hot, regenerated catalyst up the riser when all of the fresh feed is charged to an upper injection point. Microactivity tests of a commercial equilibrium catalyst with relatively high levels of deposited metals were conducted and the results are reported in Table VI. In the first test, the catalyst was not subjected to any steam treatment prior to the microactivity test. In the second test, the catalyst was treated with 100% steam for 5 hours at 1320° F. temperature prior to microactivity testing. Comparison of results reported under columns 1 and 2 in Table VI shows that the steam treatment resulted in passivation of the detrimental effect of metals and provided higher yield of liquid products and lower yields of coke and gas.

TABLE IV

| Run Number | 3 | 4 |
|---|---|---|
| Chargestock | ← Feed 2 → | |
| Catalyst | ← Catalyst 1 → | |
| Operating Conditions | | |
| Riser Outlet Temp., °F. | ← 980 → | |
| Riser Inlet Temp., °F. | ← 1200 → | |
| Riser Feed Injector | Bottom | Top |
| Contact Time (Products), sec. | 2.16 | 0.62 |
| Conversion: Vol % FF | 77.1 | 57.0 |
| Product Yields: Vol % FF | | |
| Total $C_3$ | 12.3 | 7.2 |
| $C_3$= | 10.1 | 5.7 |
| Total $C_4$ | 17.9 | 9.2 |
| $iC_4$ | 5.6 | 2.2 |
| $C_4$= | 10.8 | 6.2 |
| $C_5$–430° F. Gasoline | 56.2 | 46.1 |
| 430–650° F. Light Catalytic Gas Oil | 14.9 | 23.6 |
| 650° F.+ Decanted Oil | 8.0 | 19.3 |
| $C_3$+ Liquid | 109.3 | 105.4 |
| Product Yields: Wt % FF | | |
| $C_2$ and Lighter | 3.0 | 2.7 |
| Coke | 8.7 | 6.8 |
| Gasoline | | |
| API | 56.3 | 55.7 |
| Aromatics: Vol % | 27.9 | 24.5 |
| Olefins: Vol % | 44.8 | 51.2 |
| Saturates: Vol % | 27.3 | 24.3 |
| Motor Octane Clear | 78.2 | 77.2 |
| Research Octane Clear | 91.9 | 91.0 |
| Light Catalytic Gas Oil | | |
| API | 19.6 | 28.2 |
| Aromatics: Vol % | 67.7 | 39.7 |
| Olefins: Vol % | — | — |
| Saturates: Vol % | 32.3 | 60.3 |
| Sulfur, Wt % | 1.89 | 0.98 |
| Pour: °F. | −21 | −15 |
| Decanted Oil | | |
| API | 4.7 | 18.4 |
| Sulfur: Wt % | 3.26 | 1.77 |

TABLE V

| Run Number | 5 | 6 |
|---|---|---|
| Chargestock | ← Feed 3 → | |
| Catalyst | ← Catalyst 2 → | |
| Operating Conditions | | |
| Riser Outlet Temp., °F. | ← 980 → | |
| Riser Inlet Temp., °F. | ← 1200 → | |
| Riser Feed Injector | Bottom | Top |
| Conversion: Vol % FF | 79.2 | 77.8 |
| Product Yields: Vol % FF | | |
| Total $C_3$ | 11.3 | 8.9 |
| $C_3$= | 9.4 | 7.3 |
| Total $C_4$ | 21.5 | 15.8 |
| $iC_4$ | 5.6 | 3.3 |
| $C_4$= | 14.6 | 11.6 |
| $C_5$–430° F. Gasoline | 59.6 | 62.8 |
| 430–650° F. Light Catalytic Gas Oil | 12.1 | 16.3 |
| 650° F.+ Decanted Oil | 8.7 | 6.0 |
| $C_3$+ Liquid | 113.2 | 109.7 |
| Product Yields: Wt % FF | | |
| $C_2$ and Lighter | 3.0 | 3.2 |
| Coke | 5.4 | 6.4 |

TABLE VI

| Run Number | 7 | 8 |
|---|---|---|
| Chargestock | ← Feed 1 → | |
| Catalyst | ← Catalyst 3 → | |
| Steam Treatment | No | Yes |

TABLE VI-continued

| Run Number | 7 | 8 |
|---|---|---|
| Microactivity Test Results | | |
| Conversion, Vol % | 72.5 | 70.8 |
| Gasoline, Vol % | 56.8 | 59.5 |
| Hydrogen, Vol % | 0.26 | 0.17 |
| Coke, Wt % | 4.0 | 3.1 |

What is claimed is:

1. In a process for the conversion of hydrocarbon materials in an FCC riser reactor in which a hydrocarbon feedstock is injected into said FCC riser reactor and reacted under FCC conditions to produce a reaction product comprising a middle distillate fraction, a gasoline fraction and a heavy slurry oil fraction and in which regenerated catalyst is recycled into the bottom portion of said FCC riser reactor lifted by a catalytically inert gas the improvement which comprises: recycling at least a portion of said heavy slurry oil fraction to said FCC riser reactor without prior solvent extraction and controlling the middle distillate/gasoline ratio in said reaction product by introducing said hydrocarbon feedstock and said heavy slurry oil into said FCC reactor at vertically displaced positions, said hydrocarbon feedstock being introduced at a position higher than the position of said heavy slurry oil introduction to increase the middle distillate/gasoline ratio over that obtainable at the same FCC reactor outlet temperature were said heavy slurry oil and said hydrocarbon feedstock introduced into said reactor at the same vertical position.

2. The process of claim 1 wherein said heavy slurry oil comprises material boiling above 650° F.

3. The process of claim 1 wherein said catalytically inert gas is steam.

4. The process of claim 1 wherein said catalytically inert gas is recycled absorber gas.

5. The process of claim 1 wherein said catalytically inert gas is gas selected from the group consisting of hydrogen, hydrogen sulfide, ammonia, methane, ethane, propane, combinations thereof.

6. In a process for the conversion of hydrocarbon materials in an FCC riser reactor in which a hydrocarbon feedstock is injected into said FCC riser reactor and reacted under FCC conditions to produce a reaction product comprising a middle distillate fraction, a gasoline fraction and in which regenerated catalyst is recycled into the bottom portion of said FCC riser reactor lifted by a catalytically inert gas the improvement which comprises: recycling at least a portion of said heavy slurry oil fraction to said FCC riser reactor without prior solvent extraction and controlling the middle distillate/gasoline ratio in said reaction product by introducing said heavy slurry oil and said hydrocarbon feedstock into said FCC reactor at vertically displaced positions, said hydrocarbon feedstock being introduced at a plurality of vertical positions each higher than the position of said heavy slurry oil introduction to increase the middle distillate/gasoline ratio over that obtainable at the same FCC reactor outlet temperature were said heavy slurry oil and said hydrocarbon feedstock introduced into said reactor at the same vertical position.

7. The position of claim 6 wherein said slurry oil comprises material boiling above 650° F.

8. The position of claim 6 wherein said catalytically inert gas is steam.

9. The process of claim 6 wherein said catalytically inert gas is recycled absorber gas.

10. The process of claim 6 wherein said catalytically inert gas is gas selected from the group consisting of hydrogen, hydrogen sulfide, ammonia, methane, ethane, propane, and combinations thereof.

* * * * *